US008164018B2

(12) United States Patent
Yang

(10) Patent No.: US 8,164,018 B2
(45) Date of Patent: Apr. 24, 2012

(54) CIRCUIT BREAKER ARC CHAMBERS AND METHODS FOR OPERATING SAME

(75) Inventor: Guang Yang, Duluth, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 165 days.

(21) Appl. No.: 12/728,820

(22) Filed: Mar. 22, 2010

(65) Prior Publication Data

US 2010/0237047 A1 Sep. 23, 2010

Related U.S. Application Data

(60) Provisional application No. 61/162,417, filed on Mar. 23, 2009.

(51) Int. Cl.
*H01H 33/12* (2006.01)

(52) U.S. Cl. ..... 218/15; 218/36; 200/401; 335/201

(58) Field of Classification Search ..... 200/401; 215/15–22, 36–40; 335/201
See application file for complete search history.

(56) References Cited

U.S. PATENT DOCUMENTS

| | | | | |
|---|---|---|---|---|
| 4,362,915 | A | 12/1982 | Swindler | |
| 4,387,281 | A | 6/1983 | Haury | |
| 4,536,726 | A * | 8/1985 | Hideo | 335/23 |
| 4,585,912 | A | 4/1986 | Fischer | |
| 4,845,460 | A | 7/1989 | Manthe | |
| 5,296,827 | A | 3/1994 | Black | |
| 5,302,787 | A * | 4/1994 | Edds et al. | 200/401 |
| 5,837,954 | A * | 11/1998 | Asakawa et al. | 218/40 |
| 5,945,650 | A | 8/1999 | Holland | |
| 5,990,439 | A | 11/1999 | Pever | |
| 6,198,063 | B1 | 3/2001 | Kramer | |
| 6,373,014 | B1 * | 4/2002 | Mitsuhashi et al. | 218/22 |
| 6,400,243 | B2 * | 6/2002 | Oyama et al. | 335/132 |
| 6,573,815 | B1 * | 6/2003 | Tsukima et al. | 335/202 |
| 7,116,194 | B2 * | 10/2006 | Azzola et al. | 335/202 |
| 2002/0050886 | A1 | 5/2002 | Clickner | |
| 2003/0201853 | A1 | 10/2003 | Charles | |
| 2004/0188388 | A1 | 9/2004 | Bach | |
| 2005/0263492 | A1 | 12/2005 | McCoy | |
| 2006/0086693 | A1 | 4/2006 | Yeon | |
| 2008/0277382 | A1 | 11/2008 | Chen | |

FOREIGN PATENT DOCUMENTS

| | | | |
|---|---|---|---|
| DE | 3619241 | A1 | 12/1987 |
| DE | 19860427 | A1 | 6/2000 |
| DE | 102007001802 | A1 | 6/2008 |
| EP | 0713232 | A1 | 5/1996 |
| EP | 1876617 | A1 | 1/2008 |
| FR | 2905797 | A1 | 3/2008 |

OTHER PUBLICATIONS

U.S. Appl. No. 12/728,839, filed Mar. 22, 2010, DeBoer.

* cited by examiner

*Primary Examiner* — Truc Nguyen

(57) ABSTRACT

Embodiments provide arc chambers, and methods adapted to rapidly extinguish arcs in circuit breakers. In one aspect, a circuit breaker is provided having first and second electrical contacts, wherein at least one of the contacts is movable and has a maximum contact face transverse dimension (d), and an arc chamber including first and second sidewalls spaced by a transverse spacing (Ts). The sidewalls are provided in close proximity to each other providing a transverse arc compression ratio (TACR) less than or equal to about 2.0, wherein TACR=Ts/d. According to another aspect, an arc chamber including one or more recesses formed into a transverse sidewall is provided, as are other aspects.

24 Claims, 5 Drawing Sheets

CIRCUIT BREAKER ARC CHAMBERS AND METHODS FOR OPERATING SAME

RELATED APPLICATION

This application claims priority to Provisional Application Ser. No. 61/162,417 filed on Mar. 23, 2009, and entitled "CIRCUIT BREAKER ARC CHAMBER DESIGN THAT FACILITATES INTERRUPTIONS" the disclosure of which is hereby incorporated by reference herein in its entirety.

FIELD OF THE INVENTION

The present invention relates generally to arc chambers for extinguishing arcs in circuit breakers.

BACKGROUND OF THE INVENTION

In general, a circuit breaker operates to engage and disengage a selected electrical circuit from an electrical power supply. The circuit breaker ensures current interruption thereby providing protection to the electrical circuit from continuous over current conditions and high current transients due, for example, to electrical short circuits. Such circuit breakers operate by separating a pair of internal electrical contacts contained within a housing of the circuit breaker. Typically, one electrical contact is stationary while the other is movable (e.g., mounted on a pivotable contact arm). The contact separation may occur manually, such as by a person throwing a handle of the circuit breaker. This may engage a trip mechanism, which may be coupled to the contact arm and moveable contact. Otherwise, the electrical contacts may be separated automatically when an over current or short circuit condition is encountered. This automatic tripping may be accomplished by a tripping mechanism actuated via a thermal overload element (e.g., a bimetal element) or by a magnetic element (e.g., an actuator).

Upon separation of the electrical contacts by tripping of the circuit breaker, an electrical arc may be formed. This separation may occur due to heat and/or high current through the circuit breaker. It is desirable to extinguish such arc as quickly as possible to avoid damaging internal components of the circuit breaker. However, in previous circuit breakers, although extinguishment of such arcs has been effective, the arc may not have been extinguished as rapidly as desired. Accordingly, in some designs it may have been needed to make the internal components of the breaker somewhat thicker to account for damage that may occur to them due to the arc.

Accordingly, there is a need for apparatus, systems and methods to better extinguish an electrical arc in a circuit breaker resulting from contact separation.

SUMMARY OF THE INVENTION

According to a first aspect, a circuit breaker is provided. The circuit breaker includes first and second electrical contacts, the contacts adapted to generate an electrical arc during separation, at least one of the first and second electrical contacts being a movable electrical contact having a maximum contact face transverse dimension (d); and an arc chamber surrounding at least a portion of a space between the first and second electric contacts when in a maximum as-separated condition, the arc chamber including a first sidewall and a second sidewall spaced from each other by a transverse spacing dimension (Ts) in a transverse direction, the arc chamber including a transverse arc compression ratio (TACR) less than or equal to about 2.0, wherein TACR is defined as TACR=Ts/d.

In accordance with another aspect, an arc chamber of a circuit breaker is provided. The arc chamber includes a space within the circuit breaker adapted to extinguish electrical arcs produced due to separation of first and second electrical contacts, at least one being a moveable electrical contact and including a maximum contact face transverse dimension (d), the space including first and second transverse sidewalls; and a plurality of recesses extending into at least the first transverse sidewall, the plurality of recesses provided alongside of a travel path of the moveable electrical contact as the moveable electrical contact is swept along to a maximum as-separated condition.

In accordance with another aspect, a method of operating a circuit breaker is provided. The method includes separating a first electrical contact from a second electrical contact upon tripping of the circuit breaker, and forming an electrical arc, at least one of the first and second electrical contacts being a moveable electrical contact; and extinguishing the arc within an arc chamber which includes a transverse arc compression ratio (TACR) less than or equal to about 2.0 wherein TACR=Ts/d, Ts is a transverse spacing dimension between transverse sidewalls of the arc chamber, and d is a maximum contact face transverse dimension of the moveable electrical contact.

In accordance with another method aspect, a method of operating a circuit breaker is provided that includes separating a first electrical contact from a second electrical contact upon tripping of the circuit breaker, and forming an electrical arc, at least one of the first and second electrical contacts being a moveable electrical contact; and extinguishing at least a portion of the arc within an arc chamber by receiving at least a portion of the electrical arc within one or more recesses formed into at least one of the transverse sidewalls, the one or more recesses positioned along a travel path of the moveable electrical contact.

In accordance with another aspect, an arc chamber of a circuit breaker is provided. The arc chamber includes first and second electrical contacts adapted to generate an electrical arc during separation, at least one of the first and second electrical contacts being a movable electrical contact having a maximum contact face transverse dimension (d); and a space volume surrounding, and including, at least a portion of a space between the first and second electric contacts when in a maximum as-separated condition, the space volume at least partially defined by a first sidewall and a second sidewall spaced from each other across the space by a transverse spacing dimension (Ts) in a transverse direction wherein the space volume includes a transverse arc compression ratio (TACR) less than or equal to about 2.0, wherein TACR is defined as TACR=Ts/d.

Still other aspects, features, and advantages of the present invention may be readily apparent from the following detailed description by illustrating a number of exemplary embodiments and implementations, including the best mode contemplated for carrying out the present invention. The present invention may also be capable of other and different embodiments, and its several details may be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the spirit and scope of the invention.

DETAILED DESCRIPTION

In view of the foregoing difficulties in extinguishing the arc, there is a need to extinguish an electrical arc in such circuit breakers as soon as possible after electrical contact separation occurs. Such separation is due to circuit interruption following a circuit breaker tripping event. According to embodiments of the invention, a circuit breaker including an improved arc chamber is provided. The circuit breaker includes a first electrical contact and a second electrical contact, which are separable upon breaker tripping thereby producing an electrical arc. An arc chamber is provided adjacent to the electrical contacts. According to some embodiments, the arc chamber may surround, and include, at least a portion of a space between the electrical contacts when the contacts are in a maximum as-separated condition, i.e., when tripped. In accordance with a broad aspect of the invention, the arc chamber, when compared to prior art arc chambers, includes a reduced transverse spacing dimension (Ts) in an area between the electrical contacts when the contacts are positioned in the maximum as-separated condition. In particular, it has been discovered that by restricting the transverse cross section of the arc chamber, the electrical arc is advantageously compressed and may be extinguished in a relatively shorter time frame. Advantageously, this may allow the use of thinner walls within the housing of the circuit breaker, thinner components within the current path, and may achieve a higher current rating for the circuit breaker. Use of thinner walls and internal components may reduce the size and weight, and, thus, the cost of the circuit breaker.

Figure 1A:
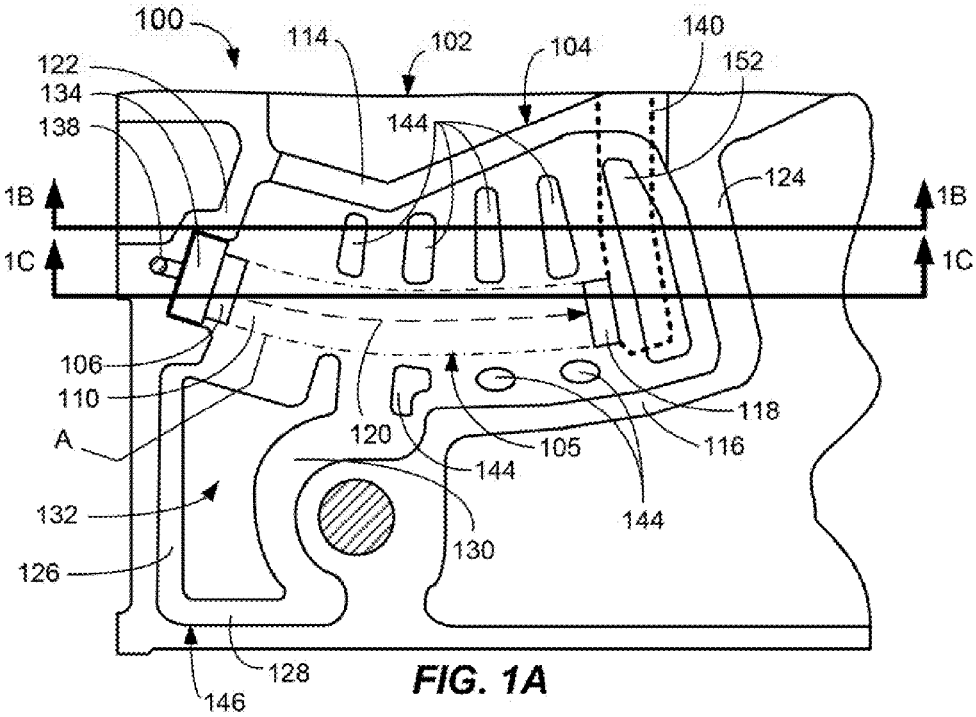
FIG. 1A is a side partial view of a circuit breaker including an arc chamber in accordance with embodiments of the present invention.
Figure 1B:
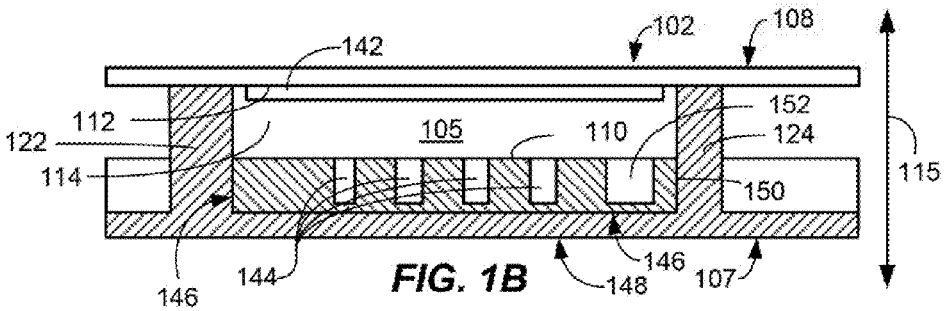
FIG. 1B is a cross-sectional view illustrating recesses formed in a transverse sidewall of an arc chamber along section line 1B-1B of FIG. 1.
Figure 1C:
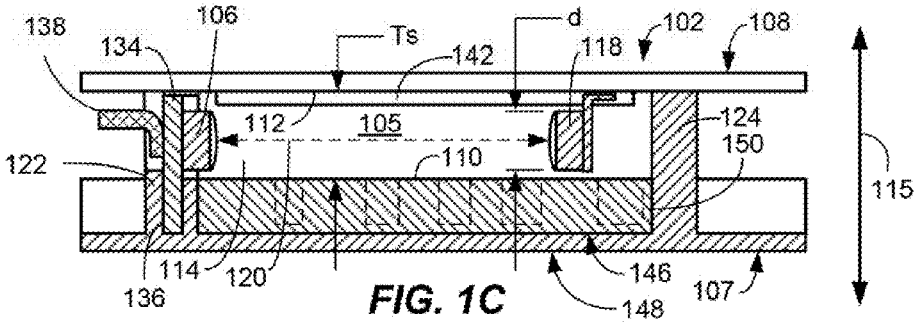
FIG. 1C is a cross-sectional view illustrating an arc chamber along section line 1C-1C of FIG. 1.

In accordance with a further aspect, the arc chamber and electrical contacts may be designed such that a desired transverse arc compression ratio (TACR) is provided. In particular, TACR less than or equal to about 2.0 may provide improved arc extinguishment. TACR is defined herein as:

$$TACR=Ts/d$$

wherein d is a maximum contact transverse dimension of a moving electrical contact at a contact face thereof in the transverse direction (See FIG. 1C), and Ts is a transverse spacing dimension between a first sidewall and a second sidewall of the arc chamber as measured in the transverse direction (See FIG. 1C).

In short, by lowering a transverse spacing dimension (Ts) of the arc chamber so that it is close to the maximum contact transverse face dimension (d) of the moveable electrical contact (e.g., less than about 2.0 times the maximum transverse contact face dimension (d) of the moveable electrical contact), rapid arc extinguishment may be accomplished.

In accordance with another broad aspect, the arc chamber of the circuit breaker may include one or more recesses formed into one or more sidewalls of the arc chamber. The one or more recesses may increase an effective surface area of the arc chamber, and thereby may contribute to rapid extinguishment of the electrical arc. In some embodiments, the one or more recesses may be provided alongside of a path of the moveable contact. In further embodiments, recesses may be provided alongside both sides of a path of the moveable electrical contact. In accordance with another aspect, the one or more recesses may be positioned outside of an area (A) circumscribed by the contact face dimension (d) of the moveable contact being swept along a travel path to the maximum as-separated condition. In this manner, portions of the arc may be extinguished in the one or more recesses.

The principles of the present invention are not limited to the illustrative examples depicted herein, but may be applied and utilized in any type of circuit breaker, either mechanical or electronic, such as single-pole circuit breakers, duplex circuit breakers, two-pole circuit breakers, multi-pole circuit breakers, ground fault circuit interrupters (GFCI), arc fault circuit interrupters (AFCI), surge protective devices (TVSS), metering circuit breakers, electronic trip unit breakers, or remotely controllable circuit breakers.

These and other embodiments of apparatus, systems and methods of the present invention are described below with reference to FIGS. 1A-6. Like reference numerals used in the drawings identify similar or identical elements throughout the several views. The drawings are not necessarily drawn to scale.

Referring now to FIG. 1A-1C, a portion of a circuit breaker 100 including the arc chamber in accordance with embodiments of the invention is illustratively shown. Circuit breaker 100 includes a housing 102, which may be molded from a suitable plastic material, for example. The material may be a thermoset material, such as a glass-filled polyester, or a thermoplastic material such as a Nylon material (e.g., Nylon 6), for example. Other materials may be used. The housing 102 may be made up of a number of interconnecting housing sections and may include an arrangement of internal and external walls 104, which are adapted to contain or retain various components of the circuit breaker 100.

Figure 2:
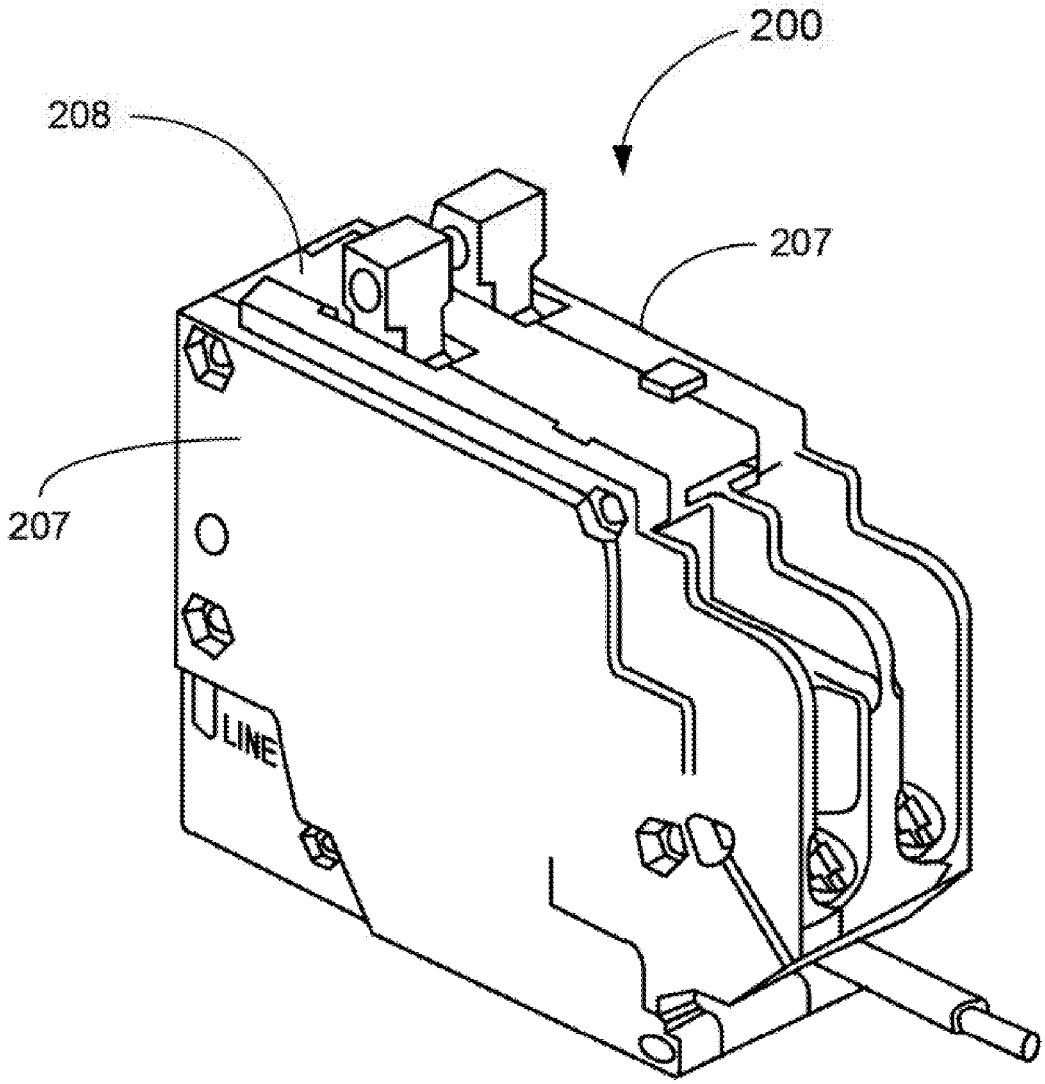
FIG. 2 is a perspective view of a circuit breaker including an arc chamber in accordance with an illustrative embodiment.

In the present invention, an arc chamber 105 is provided. The arc chamber is a space volume that serves to receive and extinguish an arc generated during a circuit breaker tripping event. The arc chamber 105 is generally defined by a first portion 107 and a second portion 108 of the housing 102 of the circuit breaker 100. These portions 107, 108 may be interconnecting halves of the circuit breaker in the case of a single-pole breaker, or portions including the tripping components for a pole in the case of a two-pole breaker, for example. Other numbers of portions may be used to define the arc chamber 105. An example of the portions 207, 208 utilized in multi-pole circuit breaker 200 are shown in FIG. 2, and more than one arc chamber 105 of the type described in FIGS. 1A-1C may be provided therein. For example, one arc chamber 105 may be provided for each electrical pole, i.e., for each set of electrical contacts included therein.

Again referring to FIGS. 1A-1C, the arc chamber 105 includes a first sidewall 110 and second sidewall 112, which are provided in a spaced relationship to one another in a transverse direction 115. The transverse direction is indicated by arrow 115 in FIGS. 1B and 1C and is generally across the thinnest dimension of the circuit breaker 100. Sidewalls 110 and 112 may be generally planar, and may be generally parallel to one another, for example. However, non-planar surfaces may also be used. The arc chamber 105 may further include first and second end walls 114, 116, which may be provided on either side of the arc chamber 105 along a length of the circuit breaker, for example. The first and second end walls 114, 116 may extend from the sidewalls 110 of portion 107 along the transverse direction 115 and interface and abut the second portion 108 at various locations, or vice versa. In some embodiments, the sidewalls may be optionally formed from extensions from both the first and second portions 107, 108.

Between the sidewalls 114, 116, a stationary electrical contact 106 and a moveable electrical contact 118 may be provided. The first and second end walls 114, 116 may be generally arranged alongside of a travel path (depicted by dotted line 120 of FIG. 1A) of a moveable electrical contact 118 upon being tripped. The travel path 120 starts with the contacts 106, 118 provided in engaging contact in a non-tripped condition (not shown), and ends at a maximum as-separated condition (tripped) as is illustrated in FIG. 1A. Third and fourth end walls 122, 124 may be provided at positions behind the stationary electrical contact 106 and moveable electrical contact 118 as shown in FIG. 1A. The third and fourth end walls 122, 124 may also extend from the sidewalls 114, 116 of the first portion 107 along the transverse direction 115 and contact the second portion 108, for example, or vice versa. As described for the first and second end walls 114, 116, the third and fourth end walls 122, 124 may optionally be formed of extensions from each of the portions 107, 108. Together, these walls at least partially define, and include, a space of the arc chamber 105 surrounding the travel path 120 of the moveable electrical contact 118.

Additional walls 126, 128, 130 may be provided and may at least partially define a reservoir 132, which is located adjacent to, and communicated with, the arc chamber 105. The additional walls 126, 128, 130 may extend from the sidewall 110 and the end surfaces thereof may be positioned at the same level as the first sidewall 110. The reservoir 132 may function as an additional closed volume, which is connected to the arc chamber 105 to allow an expansion space to make sure the pressure in the arc chamber 105 does not get to high. The reservoir 132 functions as an expansion chamber to allow gasses to expand into the reservoir 132 upon arcing. The volume of the reservoir 132 should be roughly equal to that of the arc chamber 105. In some embodiments, the reservoir 132 has a transverse dimension between respective sidewalls in the transverse direction 115 of the reservoir 132 that is larger than Ts, i.e., it is thicker than Ts. It should be recognized that the present arc chamber 105 may be connected to a reservoir 132 (e.g., internal expansion chamber), but may not have an arc chute, i.e., may be devoid of an arc chute. In prior art circuit breaker designs, an arc chute was a vent to the outside of the circuit breaker, which allowed the free escape of arc gasses from the circuit breaker following a tripping event. In accordance with another broad aspect, the circuit breaker of the present invention is devoid of an arc chute. In other words, all internal spaces connected to the arc chamber 105 are closed volumes without any appreciable escape port or vent for such gasses.

The stationary electrical contact 106 may be provided at a first location within the housing 102 and on a first end of the arc chamber 105. The stationary electrical contact 106 may be coupled to a contact terminal 134, which may be received and supported in a recess 136 (see FIG. 1C) formed in the housing 102. The power terminal (not shown) of the circuit breaker 100 may be electrically connected to the contact terminal 134, such as by a braided metal line 138 or other electrical conductor, for example.

The moveable electrical contact 118 is also provided in the arc chamber 105, and is depicted in FIGS. 1A and 1C in the maximum separated condition (i.e., in a tripped position and at its maximum excursion, for example). The moveable electrical contact 118 may be coupled to a contact arm 140 (shown dotted). The contact arm 140 may be tripped upon the circuit breaker 100 encountering a persistent over current condition, a high current (short circuit), an over temperature condition, a ground fault, an arc fault condition or manually, for example, depending upon the type of circuit breaker the arc chamber 105 is included within. Any type of tripping mechanism known in the art may be used to trip and move the moveable electrical contact 118. The entire portion of the contact arm 140 may be included within the arc chamber 105 in some embodiments, or the contact arm 140 may extend through and slide within a thin slot 142 upon encountering a breaker tripping event. The thin slot 142 may be formed by the interaction of the end walls 114 extending between the first and second portions 107, 108. For example, the end wall 114 may be shorter than the end wall 114 at other locations along its length.

In other words, the end wall may not contact the portion 108 along a short section of the end wall 114, to allow the full excursion of the contact arm 140 upon a tripping event.

According to aspects of the invention, a time for extinguishing an arc generated by electrical contact separation during a circuit breaker tripping event may be shortened or minimized. This improvement in arc extinguishment may be accomplished in one aspect by controlling a cross-sectional area of the arc chamber 105 in a transverse direction. In particular, the inventor has discovered that, by narrowing a spacing between a first sidewall 110 and a second sidewall 112 to a transverse spacing dimension (e.g., thickness dimension), which is calculated based on a maximum contact face dimension of the moveable electrical contact (d), better arc extinguishment is achieved. In other words, closely spacing the surfaces of the sidewalls 110, 112 by a distance (Ts) in a transverse direction 115 acts to effectively constrain or compress the electrical arc formed between the electrical contacts 106, 118. This is thought to enhance a conduction heat transfer of the electrical arc, but also may reduce an electrical conductivity of the arc. These effects may lead to higher arc voltage and thus relatively quicker arc extinguishment.

In more detail, and in accordance with an aspect of the invention, rapid extinguishment may be accomplished when:

TACR is less than or equal to about 2.0 wherein TACR is a transverse arc compression ratio, and is defined by the relationship:

$$TACR = Ts/d$$

where

Ts is a transverse spacing dimension between the first sidewall 110 and a second sidewall 112 of the arc chamber 105 in the transverse direction 115, and d is a maximum transverse contact face dimension of the moveable electrical contact 118 along the transverse direction 115.

This spacing Ts is measured in a region along the travel path 120 of the moveable electrical contact 118. In particular, the invention may function best when the transverse spacing dimension Ts is controlled in accordance with the above relationship within an entire area (A) circumscribed (in the transverse direction 115) by the moveable electrical contact 118 as it moves along the travel path 120. This area (A) is referred to herein as the "squeezing band." The squeezing band is the band adjacent to the electrical contacts that effectively constrains the arc in the transverse direction 115. The dimension d is generally measured at the face of the moveable electrical contact. Generally, the dimension d will be a diameter of a contact face (i.e., the face which contacts the first contact 106) of the moveable electrical contact 118 measured in the transverse direction 115.

It should be recognized that some benefits of the invention may be realized even when Ts is controlled according to the above relationship for some, but not all, areas within the squeezing band. Thus, according to this aspect, by moving the sidewalls 110, 112 of the arc chamber 105 closer to the electrical contacts 106, 118 in the transverse direction 115 according to the above relationship only within some regions of the squeezing band, better arc extinguishment may be provided. In other aspects, providing arc chambers 105 with TACR≦1.8, TACR≦1.6, or even TACR≦1.5 may provide relatively improved arc extinguishment.

In accordance with another aspect of the invention, an arc chamber 105 of a circuit breaker 100 is provided. In this aspect, the arc chamber 105 is adapted to extinguish electrical arcs produced due to separation of first and second electrical contacts 106, 118, wherein at least one contact is a moveable contact and includes a transverse contact face dimension d. The arc chamber 105 includes first and second transverse sidewalls 110, 112, and includes one or more recesses 144, and in the depicted embodiment, a plurality of recesses 144 extending (e.g., formed into via molding) into at least the first transverse sidewall 110 of the arc chamber 105. One or more recesses may be formed into the other housing portion 108, as well. The one or more recesses 144, and preferably a plurality of recesses 144, may be provided alongside of the travel path 120 of movement of the moveable electrical contact 118.

In the depicted embodiment, the one or more recesses 144, and preferably a plurality of recesses 144, is/are positioned outside of the area (A) circumscribed (in the transverse direction) by the contact face of the moveable electrical contact 118 being swept along the travel path 120 to the maximum as-separated position of the moveable contact 118 shown in FIG. 1A. Area (A) is shown dotted and dashed in FIG. 1A. According to the depicted embodiment, a plurality of recesses 144 may extend into the first sidewall 110 of the arc chamber 105 and the plurality of recesses 144 may be provided along both sides of the travel path 120 of the moveable electrical contact 118. In some embodiments, the plurality recesses 144 may encroach slightly into the squeezing band, i.e., overlap with the area (A).

In some embodiments, the one or more recesses 152 may extend into (e.g., be formed into via molding) at least the first transverse sidewall 110 of the arc chamber 105 and may be positioned behind the moveable electrical contact 118 when the moveable electrical contact 118 is positioned in the maximum as-separated condition (shown in FIG. 1A).

In the depicted embodiment of FIGS. 1A-1C, the arc chamber 105 is at least partially formed from a separate component 146 of the housing 102. The separate component 146 is part of the portion 107 and is provided in a fixed relationship to a receiving component 148 of the portion 107. For example, the separate component 146 may be received and seated in a pocket 150 formed into the receiving component 148 during molding. The separate component 146 may be made of a different material than the receiving component 148. For example, the separate component 146 may be made of a material more resistant to arc damage, or which better extinguishes the arc, such as Nylon 6, for example. The receiving component 148 may be made from a less expensive thermoset plastic material. The separate component 146 may be fixedly secured into the pocket 150 by any suitable means, such as adhesive, mechanical interface, one or more detent features, mechanical fastening, snapping into place, etc.

The one or more recesses 144 may be molded into the separate component 146. The one or more recesses 144 may extend only part of the way through the separate component 146 as shown in FIGS. 1B and 1C, or the one or more recesses 144 may extend all the way through the separate component 146, such that a bottom of each recess 144 is the bottom of the pocket 150. Although shown as being holes of substantially equal depth, the recesses 144 may be of unequal depth. In some embodiments, a depth of the recesses 144 may be greater than about 0.125 inch (greater than about 3.2 mm), or even greater than about 0.15 inch (greater than about 3.8 mm). In some embodiments, the depth of the recesses 144 should be between about 0.125 inch (about 3.2 mm) and about 0.75 inch (about 19 mm), for example. Furthermore, each recess 144 may be a hole, and at least some of the recesses 144 may have nonequal cross-sectional area, when viewed along the transverse direction 115. In another aspect, the recesses 144 extending into the first sidewall 110 of the arc chamber 105 may comprise holes being spaced from one another in relatively equal increments alongside of the travel path 120. In some embodiments, a plurality of recesses 144 are provided along the travel path 120 and on both sides of the moveable electrical contact 118.

It should be recognized that several aspects described herein may be provided in combination with each other to provide even further improved arc extinguishment. For example, the arc chamber 105 including one or more recesses 144 formed into the first sidewall 110 and/or second sidewall 112 of the arc chamber 105 may be combined with controlling the transverse spacing dimension of the arc chamber 105 to achieve a transverse arc compression ratio (TACR) that is less than or equal to about 2.0, as described above, wherein TACR=Ts/d, and Ts is a transverse spacing dimension in the transverse direction 115, that the first and second transverse sidewalls 110, 112 are spaced from one another. A particularly good arc chamber 105 may include TACR between about 1.5 and 2.0, a plurality of recesses 144 spaced along both sides of the travel path 120, and wherein each of the recesses 144 has a depth of between about 0.1 inch (about 2.5 mm) and about 0.25 inch (about 6.3 mm).

Figure 3:
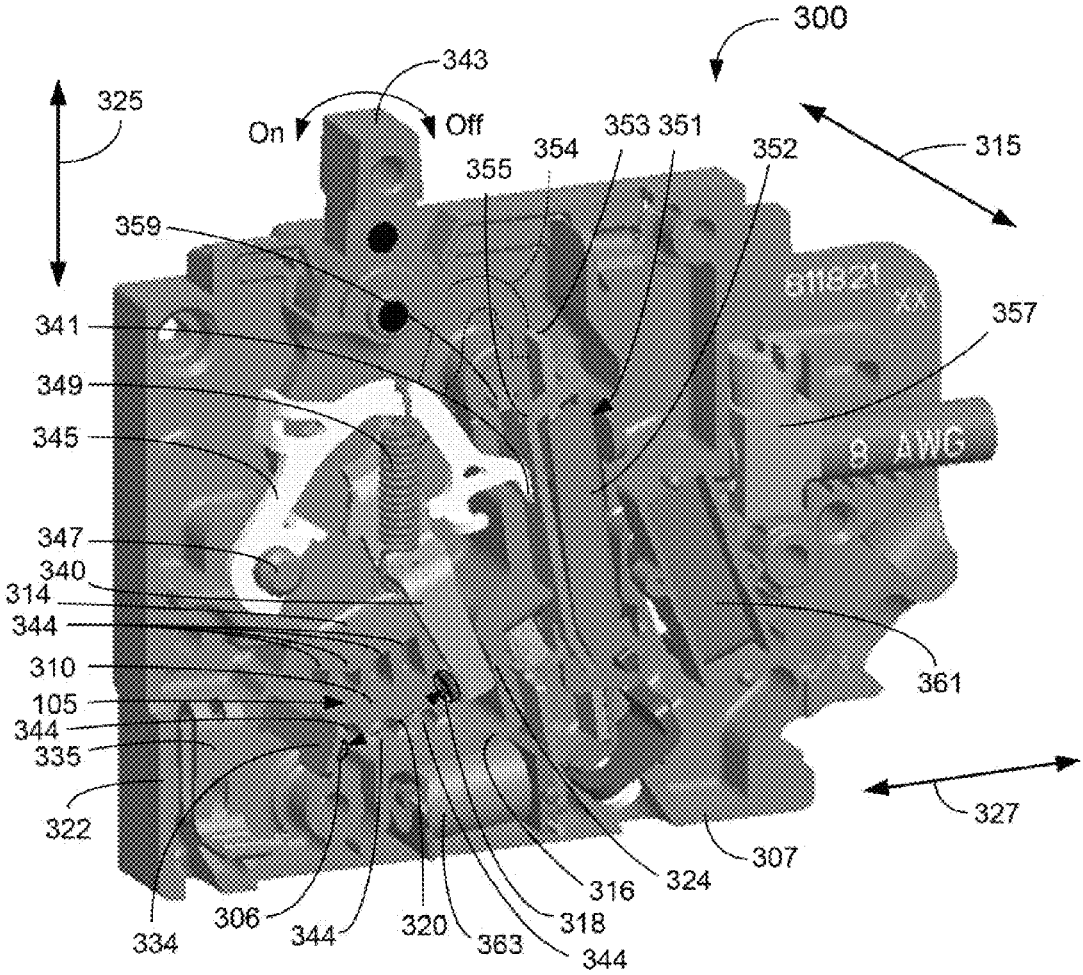
FIG. 3 is a perspective view of a portion of a circuit breaker including an arc chamber in accordance with an illustrative embodiment.

FIG. 3 illustrates another embodiment of the present invention arc chamber 305 provided in a circuit breaker 300. Only a portion of the circuit breaker 300 is shown. In the depicted embodiment, a housing portion 307 of the circuit breaker 300 is shown. In this embodiment, the arc chamber 305 is formed by the housing portion 307 and another housing portion which interfaces with it (not shown). The housing portion 307 forms a first transverse sidewall 310 of the arc chamber 305. A second transverse sidewall is formed by the other housing portion (not shown) that interfaces with the portion 307. The other housing portion may be a cover, for example. Optionally, the other portion may house electronic processing module. The arc chamber 305 extends between the first transverse sidewall 310 and the second transverse sidewall (not shown). The transverse direction is illustrated by arrow 315.

As discussed above, in accordance with one aspect of the invention, the transverse spacing dimension (Ts) of the transverse sidewalls of the arc chamber 305 may be selected to provide a transverse arc compression ratio of less than or equal to about 2.0. This improves arc extinguishment as compared to a larger TACR. The depicted circuit breaker 300 includes a stationary contact 306 and moveable contact 318, which are positioned within the space of the arc chamber 305. The stationary contact 306 may be welded to a terminal 334, which connects to the power terminal 335 by a suitable electrical conduit (e.g., wire), for example (not shown). The arc chamber 305 may be further defined by end walls 314, 316, in a first cross-wise dimension as indicated by arrow 325, and by end walls 322, 324 in a second cross-wise dimension as indicated by arrow 327. The moveable contact 318 moves along a travel path 320 to a maximum as-separated condition as the contacts 306, 318 are separated upon tripping of the breaker 300. Tripping of the circuit breaker 300 moves the contact arm 340, and thus the moveable contact 318 along the travel path 320. This separation causes an arc as the current to the electrical circuit protected by the breaker is tripped. In some embodiments, some or all of the contact arm 340 and/or some of the tripping components may be provided within the arc chamber 305. However, in most instances, it is desirable to limit arc exposure to such components, so only a portion of the contact arm 340 may be received in a relatively close fitting slot (like slot 142) formed by the interaction of the wall 314 and a housing portion (not shown) which abuts the housing portion 307.

The tripping may be accomplished via hand tripping by a person moving the handle 343 from an On to an Off position. Tripping the handle 343 causes a portion of the handle mechanism to contact a cradle 345 and causes the spring 349 to exert a force to move the contact arm 340 along the travel path 320 to the maximum as-separated condition, i.e., a tripped position (as shown).

In other instances, a tripping unit 351 may trip the circuit breaker 300 when a persistent current experienced by the tripping unit 351 causes a temperature increase that exceeds a predetermined threshold. The tripping unit 351 may include a bimetal member 353, an armature 355, and a magnet 352. Electrical current passes through the bimetal member 353 and to the contact arm 340 by way of an electrical conduit 354 (e.g., braided line) shown dotted for clarity) connecting the upper end of the bimetal member and the contact arm 340. The bimetal member 353 displaces towards the magnet 352 in the direction of the load lug 357 of the breaker 300 due to increased temperature. When the threshold temperature is exceeded, this causes the bimetal element 353 to contact an engagement tab of the armature 355 thereby disengaging the cradle 345 from a latching surface 359 of the armature 355. In turn, this causes rotation of the cradle 345 and the separation of the electrical contacts 306, 318 via the spring 349 exerting a force to cause a rotation of the contact arm 340. After tripping, the cradle 345 may come to rest on stop 341.

In another instance, tripping of the circuit breaker 300 may be accomplished when a short circuit condition in the protected circuit causes a high current in the bimetal member 352. This may induce a magnetic field in the magnet 352 and may magnetically attract the armature 355 which includes a ferromagnetic material, such as steel. This causes the tripping surface 345A of the cradle 345 to disengage from the latching surface 359 of the armature 355 and trip the circuit breaker 300. This causes the cradle 345 to rotate clockwise, and in doing so, causes the spring 349 to exert a force on the contact arm 340 to move the moveable contact 318 along the travel path 320.

In yet another instance, tripping of the circuit breaker 300 may be accomplished automatically upon an electronic processing circuit (not shown) in the circuit breaker 300 determining a condition of the protected circuit via a sensor 361. Upon determining that an unwanted electrical condition exists in the protected circuit (e.g., an arc fault, or a ground fault, etc.), the electronic processing circuit (not shown) may cause an actuator 363 to contact the armature 355 and cause the disengagement of the cradle 345 from the latching surface 359. This trips the circuit breaker 300. These tripping events due to over current, short circuit, or experiencing an unwanted condition in the protected circuit may cause an electrical arc, which may be rapidly extinguished by the present invention.

In accordance with another aspect, the arc chamber 305 shown in FIG. 3 may include one or more recesses 344 formed into the first transverse sidewall 310. These recesses 344, as described above, may receive a portion of the arc and promote rapid arc extinguishment. In the depicted embodiment, multiple recesses 344 are provided. The recesses 144 may be molded into the sidewall 310 of the housing portion 307. In particular, the recesses 344 may be provided alongside of the travel path 320. In some embodiments, the recesses 344 may be provided on both sides of the travel path 320 in the first cross-wise direction 325, and may be spaced at relatively equal increments along the travel path 320. Recesses which are the same or similar to recesses 344 may be formed in to the other housing portion (not shown). All recesses 344 may have a depth as described above.

Figure 4:
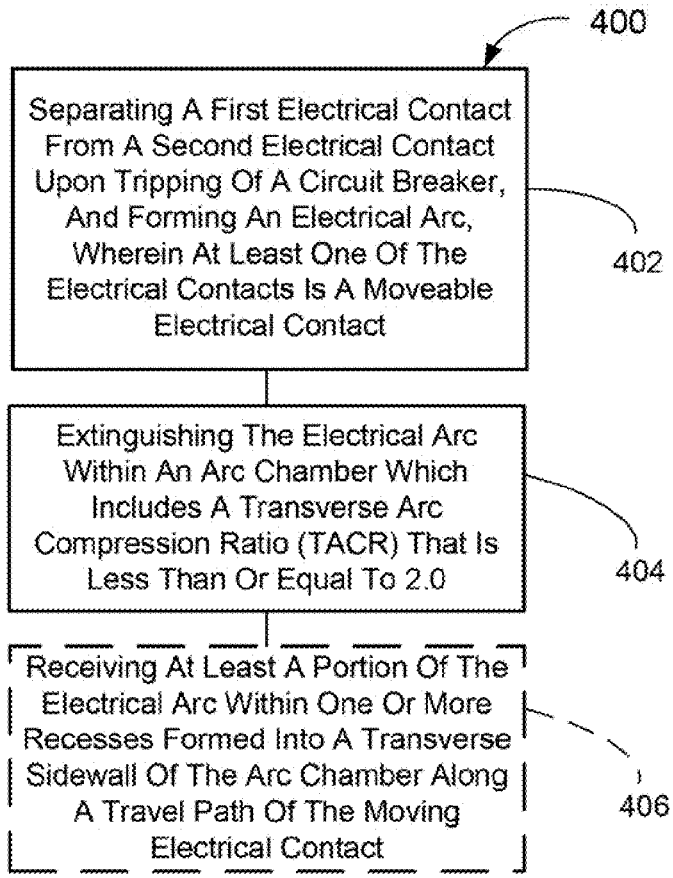
FIG. 4 shows a method for using a circuit breaker in accordance with an aspect of the present invention.

According to another aspect, a method of operating a circuit breaker is provided. As shown in FIG. 4, the method 400 includes separating a first electrical contact from a second electrical contact upon tripping of the circuit breaker, and forming an electrical arc in 402, wherein at least one of the first and second electrical contacts is a moveable electrical contact. For example, as shown in FIG. 1A, electrical contacts 106, 118 are provided and electrical contact 118 is a moveable contact. The tripping may be due to a hand trip by a customer or technician throwing the breaker handle, a trip because of a persistent over current condition, a trip because of a short circuit, or a trip through sensing an unwanted electrical condition in the protected circuit (e.g., an arc fault or ground fault, etc.) and actuating an actuator, for example. The method 400 further includes extinguishing the electrical arc within an arc chamber 105 in 404, wherein the arc chamber 105 includes a transverse arc compression ratio (TACR) that is less than or equal to about 2.0, wherein TACR=Ts/d, and Ts and d are as described above. Of course, in addition to the method described in 402 and 404, in 406, the method 400 may optionally include receiving at least a portion of the electrical arc within one or more recesses formed into at least one of the transverse sidewalls along a travel path of the moveable electrical contact. For example, recesses 144 (e.g., holes) may be provided alongside one side or both sides of the travel path 120 as shown in FIG. 1A.

Figure 5:
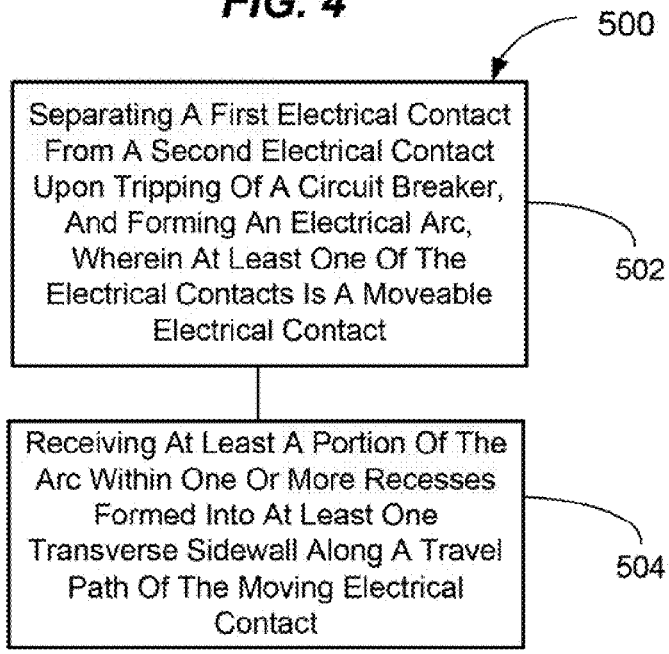
FIG. 5 illustrates another method for using a circuit breaker in accordance with another aspect of the present invention.

According to another method aspect, a method of operating a circuit breaker is provided. As shown in FIG. 5, the method 500 includes separating a first electrical contact from a second electrical contact upon tripping of the circuit breaker, and forming an electrical arc in 502, wherein at least one of the first and second electrical contacts is a moveable electrical contact. For example, as shown in FIG. 1A, first and second electrical contacts 106, 118 are provided, and electrical contact 118 is a moveable electrical contact. The method 500 further includes extinguishing at least a portion of the arc within an arc chamber in 504 by receiving at least a portion of the electrical arc within one or more recesses formed into one or more of the transverse sidewalls along a travel path of the moveable electrical contact. For example, one or more recesses 144 (e.g., holes) may be provided alongside one side or both sides of the travel path 120 as shown in FIG. 1A, and may receive at least a portion of the electrical arc. In some embodiments, a portion of the arc may be received in a plurality of recesses, which are formed into one or more of the transverse sidewalls. In an especially effective embodiment, a plurality of recesses may be formed into one or more of the transverse sidewalls alongside of a travel path of the moveable electrical contact.

Figure 6:
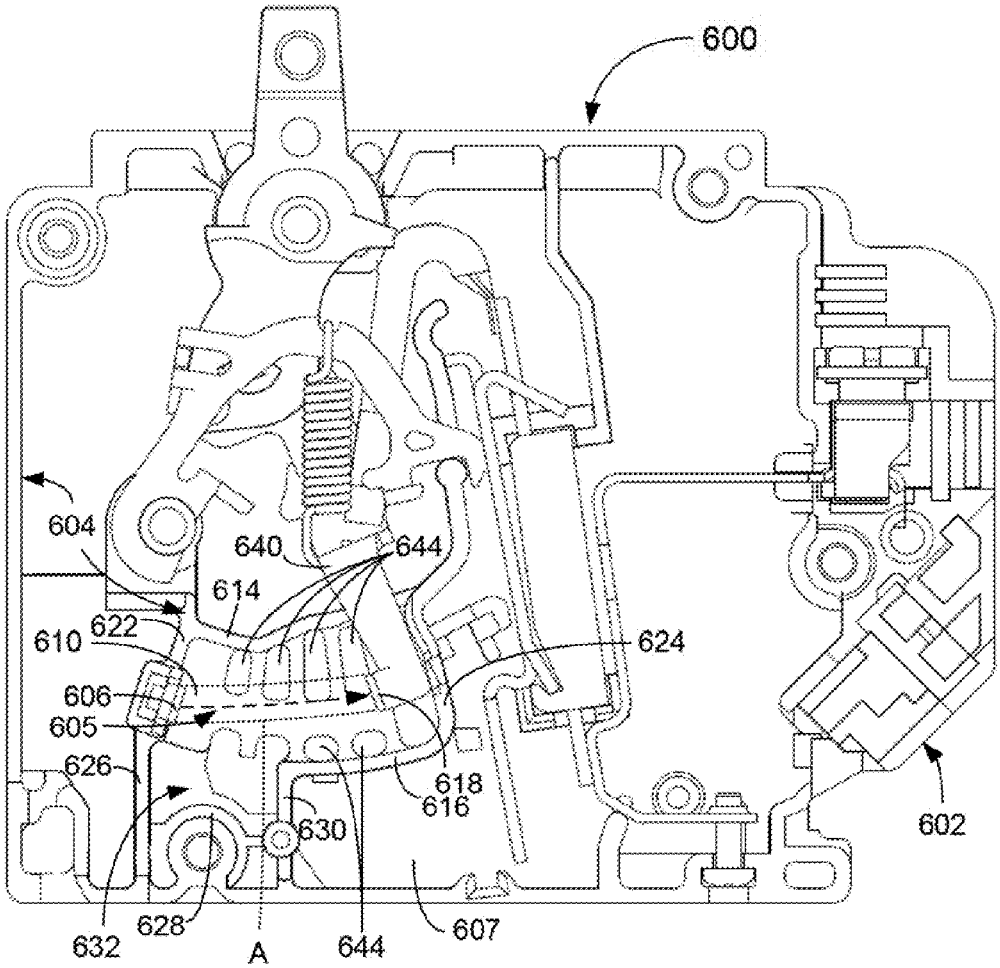
FIG. 6 is a side view of a portion of a circuit breaker including an arc chamber in accordance with another illustrative embodiment.

FIG. 6 illustrates yet another embodiment of an arc chamber 605 for a circuit breaker 600. This embodiment is similar to the FIG. 3 embodiment, but differs in the configuration of the mechanical components and clearly shows the confines of the arc chamber 605. In more detail, the circuit breaker 600 includes a housing 602, which may be molded from a suitable plastic material, as discussed above. The housing 602 may be made up of a number of interconnecting housing sections and may include an arrangement of internal and external walls 604, which are adapted to contain or retain various components of the circuit breaker 600.

The arc chamber 605 in this embodiment is generally defined by a first housing portion 607 and a second housing portion which abuts the first housing portion (e.g., 208 of FIG. 2). These housing portions may be interconnecting halves of the circuit breaker in the case of a single-pole breaker, or housing portions containing the tripping components for a pole in the case of a two-pole breaker, duplex breaker or multi-pole breaker, for example. Other numbers of portions may be used to define the space of the arc chamber 605. One arc chamber 605 may be provided for each electrical pole, i.e., for each set of electrical contacts included therein.

Again referring to FIG. 6, the arc chamber 605 includes a first sidewall 610 and second sidewall (on the other housing portion). The sidewalls are provided in a spaced relationship to one another in a transverse direction (into and out of the paper, as shown). Sidewalls may be generally planar, and may be generally parallel to one another, for example. However, non-planar surfaces may also be used. The arc chamber 605 may include first and second end walls 614, 616, which may be provided on either side of the arc chamber 605 along a length of the circuit breaker 600, for example. The first and second end walls 614, 616 may extend from the sidewall 610 along the transverse direction and interface and abut the second housing portion at various locations, vice versa, or may be formed from extensions from both the first and second housing portions.

Between the transverse sidewalls and positioned in the arc chamber 605, a stationary electrical contact 606 and a moveable electrical contact 618 may be provided. The first and second end walls 614, 616 may be generally arranged alongside of a travel path 620 (depicted by dotted line) of a moveable electrical contact 618 upon being tripped. Third and fourth end walls 622, 624 may be provided at positions behind the stationary and moveable electrical contacts 606, 618. The third and fourth end walls 622, 624 may also extend connect to the sidewalls 614, 616 and contact the second housing portion (not shown), for example. Together, these walls at least partially define, and include, a space of the arc chamber 605.

Additional walls 626, 628, 630 may be provided and may at least partially define a reservoir 632 as described above, which is located adjacent to, and in fluid communication with, the arc chamber 605. The reservoir 632 may be of approximately comparable volume as the arc chamber 605. For example, the volume may be within 50%, or even 25% of the volume of the arc chamber 605. Other volumes may be used. As described above, and in another broad aspect, the circuit breaker 600 of the present invention is devoid of an arc chute. In other words, all internal spaces connected to the arc chamber 605 are closed volumes without any appreciable escape port or vent for such gasses to escape to outside of the circuit breaker 600. An arc chute comprises a fairly wide channel that interconnects to the arc chamber and allows venting of gases to the outside of the circuit breaker. An example of an arc chute is shown in U.S. Pat. No. 7,391,289, for example.

In the depicted embodiment, the moveable electrical contact 618 may be coupled to a contact arm 640. The contact arm 640 may be tripped upon the circuit breaker 600 encountering a persistent over current condition, a high current (short circuit), a ground fault, an arc fault condition, or tripped by hand, for example, depending upon the type of circuit breaker the arc chamber 605 is included within. Any type of tripping mechanism known in the art may be used to trip and move the contact arm 640 and moveable electrical contact 618. In the depicted embodiment, a portion of the contact arm 140 may be included within the arc chamber 605. In particular, the contact arm 640 may extend through thin slot formed between the housing portions at the wall 614, as described above.

As can be seen, in the present invention a plurality of recesses 644 are provided alongside, and positioned on either side, of the travel path 620. However, as can be seen, a portion of the recesses 644 may fall within, or encroach upon, the area (A), shown dotted, which is circumscribed by sweeping the moveable contact 618 along the travel path 620. The recesses 644 may be as described above. In particular, they may be formed (e.g., molded) into the transverse sidewall 610 and/or the sidewall of the other housing member defining the arc chamber 605. As described above, this aspect may be combined with controlling TACR as described above to facilitate excellent arc extinguishment.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the spirit and scope of the invention.

What is claimed is:

1. A circuit breaker, comprising:

first and second electrical contacts, the contacts adapted to generate an electrical arc during separation, at least one of the first and second electrical contacts being a movable electrical contact having a maximum contact face transverse dimension (d); and an arc chamber surrounding at least a portion of a space between the first and second electric contacts when in a maximum as-separated condition, the arc chamber including a first sidewall and a second sidewall spaced from each other by a transverse spacing dimension (Ts) in a transverse direction, the arc chamber including a transverse arc compression ratio (TACR) less than or equal to about 2.0 wherein TACR is defined as TACR=Ts/d.

2. The circuit breaker of claim 1, comprising one or more recesses extending into the first sidewall of the arc chamber.

3. The circuit breaker of claim 2, wherein the one or more recesses are provided alongside a travel path of the moveable electrical contact.

4. The circuit breaker of claim 2, wherein the one or more recesses are provided alongside of a travel path of the moveable electrical contact, and the one or more recesses being positioned outside of an area (A) circumscribed by a contact face of the moveable electrical contact being swept along the travel path to a maximum as-separated condition of the moveable electrical contact.

5. The circuit breaker of claim 1, wherein the arc chamber is at least partially formed from a separate component, which is provided in a fixed relationship to a receiving component of a housing of the circuit breaker.

6. The circuit breaker of claim 5, wherein the separate component is manufactured from a different material than the receiving component of the circuit breaker.

7. The circuit breaker of claim 5, wherein the separate component is seated into a pocket of the receiving component of the circuit breaker.

8. The circuit breaker of claim 1, comprising a plurality of recesses extending into the first sidewall of the arc chamber wherein the plurality of recesses are provided along both sides of a travel path of the moveable electrical contact.

9. The circuit breaker of claim 1, comprising at least one recess positioned behind the moveable electrical contact when the moveable electrical contact is positioned in the maximum as-separated condition.

10. The circuit breaker of claim 1, comprising a plurality of recesses extending into the first sidewall of the arc chamber, each of the plurality of recesses comprising a hole having substantially equal depth.

11. The circuit breaker of claim 1, comprising a reservoir having a transverse dimension larger than Ts.

12. The circuit breaker of claim 1, comprising TACR less than or equal to about 1.8.

13. The circuit breaker of claim 1, comprising TACR less than or equal to about 1.6.

14. The circuit breaker of claim 1, wherein the arc chamber is a closed space and the circuit breaker is devoid of an arc chute providing a path for arc gasses to exit to an exterior of the circuit breaker.

15. The circuit breaker of claim 1, comprising a plurality of recesses extending into the first sidewall of the arc chamber, each recess comprising a hole, at least some of which have a nonequal cross-sectional area.

16. The circuit breaker of claim 1, comprising a plurality of recesses extending into the first sidewall of the arc chamber, each recess comprising a hole and being spaced from one another in substantially equal increments along a travel path of the moveable electrical contact.

17. An arc chamber of a circuit breaker, comprising:

a space within the circuit breaker adapted to extinguish electrical arcs produced due to separation of first and second electrical contacts, at least one being a moveable electrical contact and including a maximum contact face transverse dimension (d), the space including:

first and second transverse sidewalls; and a plurality of recesses extending into at least the first transverse sidewall, the plurality of recesses provided alongside of a travel path of the moveable electrical contact and positioned outside of an area (A) circumscribed by the contact face of the moveable electrical contact as the moveable electrical contact is swept along to a maximum as-separated condition.

18. The arc chamber of claim 17, wherein at least some of the plurality of recesses encroach upon the area (A) circumscribed by the contact face of the moveable electrical contact as the moveable electrical contact is swept along to the maximum as-separated condition.

19. The arc chamber of claim 17, wherein the arc chamber includes a transverse arc compression ratio (TACR) less than or equal to about 2.0;

wherein TACR=Ts/d, and Ts is a transverse spacing dimension, in a transverse direction, that the first and second transverse sidewalls are spaced from each other.

20. A method of operating a circuit breaker, comprising:

separating a first electrical contact from a second electrical contact upon tripping of the circuit breaker, and forming an electrical arc, at least one of the first and second electrical contacts being a moveable electrical contact; and extinguishing the arc within an arc chamber which includes a transverse arc compression ratio (TACR) less than or equal to about 2.0;

wherein TACR=Ts/d,

Ts is a transverse spacing dimension between transverse sidewalls of the arc chamber, and d is a maximum contact face transverse dimension of the moveable electrical contact.

21. The method of claim 20, receiving at least a portion of the electrical arc within one or more recesses formed into one or more of the transverse sidewalls, the one or more recesses positioned along a travel path of the moveable electrical contact.

22. A method of operating a circuit breaker, comprising:

providing one or more recesses formed into at least one transverse sidewalls of an arc chamber, the one or more recesses positioned along a travel path of a moveable electrical contact and positioned outside of an area (A) circumscribed by the contact face of the moveable electrical contact;

separating a first electrical contact from a second electrical contact upon tripping of the circuit breaker, and forming an electrical arc, at least one of the first and second electrical contacts being the moveable electrical contact; and extinguishing at least a portion of the arc within an arc chamber by receiving at least a portion of the electrical arc within one or more of the recesses.

23. An arc chamber of a circuit breaker, comprising:

first and second electrical contacts adapted to generate an electrical arc during separation, at least one of the first and second electrical contacts being a movable electrical contact having a maximum contact face transverse dimension (d); and a space volume surrounding, and including, at least a portion of a space between the first and second electric contacts when in a maximum as-separated condition, the space volume at least partially defined by a first sidewall and a second sidewall spaced from each other across the space by a transverse spacing dimension (Ts) in a transverse direction wherein the space volume includes a transverse arc compression ratio (TACR) less than or equal to about 2.0, wherein TACR is defined as TACR=Ts/d.

24. A circuit breaker, comprising:

a housing having a first portion and a second portion;

an arc chamber, wherein the arc chamber is a space volume defined by the first portion and second portion of the housing, the arc chamber including a first sidewall and a second sidewall spaced from each other by a transverse spacing dimension (Ts) in a transverse direction, and a first end wall and a second end wall extending from the first and second sidewalls along the transverse direction;

a stationary electrical contact and a moveable electrical contact provided between the first and second sidewalls, the moveable electrical contact coupled to a contact arm, the contacts adapted to generate an electrical arc during separation, and the movable electrical contact having a maximum contact face transverse dimension (d);

an area circumscribed in the transverse direction by the moveable electrical contact as it moves along a travel path to a maximum as-separated position;

a reservoir positioned adjacent to the arc chamber adapted to function as an expansion chamber; and a plurality of recesses formed in the arc chamber alongside the travel path of the moveable electrical contact, at least one of which is positioned outside the area circumscribed in the transverse direction by the moveable electrical contact as it moves along the travel path.

* * * * *